United States Patent [19]

Siemes et al.

[11] 3,960,063

[45] June 1, 1976

[54] ROOF FAN

[75] Inventors: Franz Siemes, Friedberg; Kraus; Joachim Buhl, both of Neunkirchen, all of Germany

[73] Assignee: Blech- und Metallwarenfabrik Robert Fischbach KG, Neunkirchen, Germany

[22] Filed: July 18, 1974

[21] Appl. No.: 489,461

[52] U.S. Cl. ..... 98/43 R; 181/36 R; 417/360

[51] Int. Cl.[2] ..... F24F 7/02

[58] Field of Search ..... 181/36 R, 42, 50; 98/43, 20; 417/360

[56] References Cited

UNITED STATES PATENTS

| | | | |
|---|---|---|---|
| 2,458,045 | 1/1949 | Angus | 417/360 X |
| 2,562,600 | 7/1951 | Cadwell et al. | 98/43 |
| 2,875,678 | 3/1959 | Shepherd | 98/43 R |
| 3,078,781 | 2/1963 | Jentoft | 98/43 R |
| 3,433,145 | 3/1969 | Daly et al. | 98/43 R |
| 3,435,911 | 4/1969 | Greenheck | 98/43 R |
| 3,482,767 | 12/1969 | Reinkoester, Jr. | 98/43 R X |
| 3,722,396 | 3/1973 | Peill et al. | 98/43 X |

*Primary Examiner*—William E. Wayner
*Assistant Examiner*—William E. Tapolcai, Jr.
*Attorney, Agent, or Firm*—Woodhams, Blanchard and Flynn

[57] ABSTRACT

A roof fan having an air-quieting casing or sound reducing device on the suction side. A blower is mounted inside a housing and the impeller shaft extends vertically. The blower and the surrounding housing are pivotally arranged on the casing so that not only the blower is rendered accessible but also the sound reducing devices and the suction channel.

7 Claims, 6 Drawing Figures

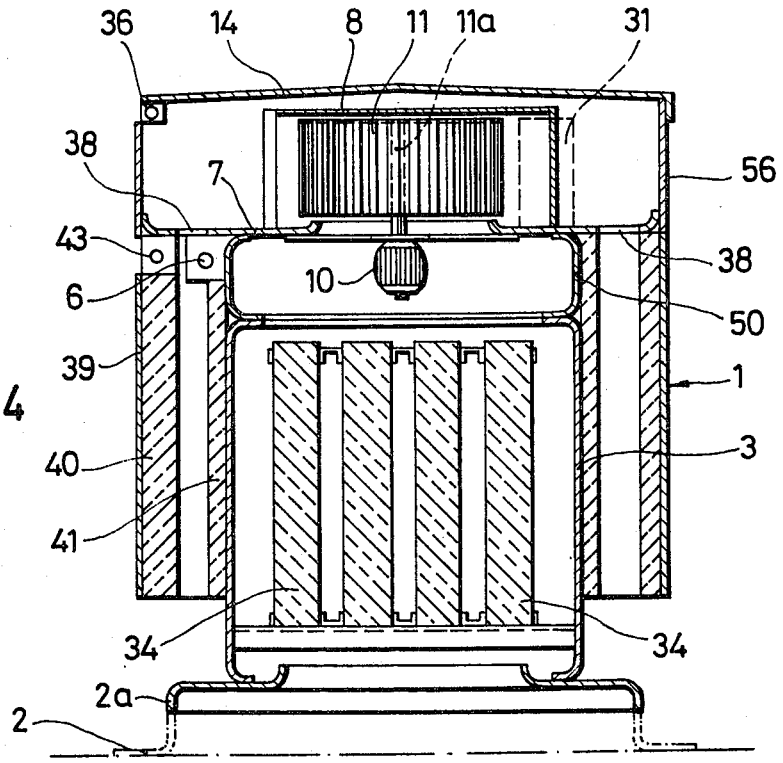
Fig. 4
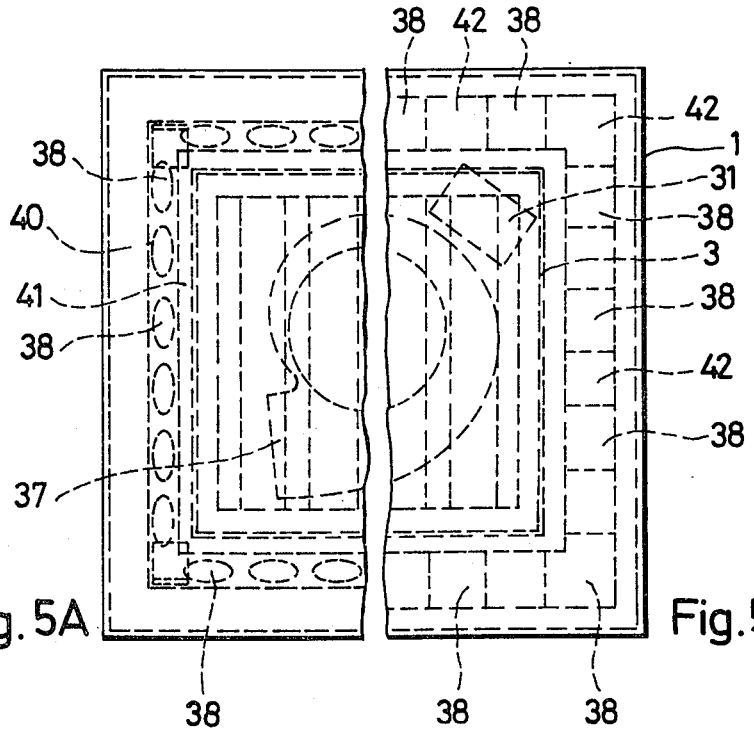
Fig. 5A
Fig. 5B

ROOF FAN

FIELD OF THE INVENTION

The invention relates to a roof fan and, more particularly, an improvement over the structure illustrated in U.S. Pat. No. 3,219,143.

BACKGROUND OF THE INVENTION

The primary disadvantage of the fan construction in U.S. Pat. No. 3,219,143 consists, on the one side, in the difficulty presented when servicing the suction channel and the sound reducing plates. Both of these parts must be cleaned at regular time intervals, or the sound reducing plates must be replaced. To carry out such servicing, the blower which is fixedly mounted on the sound reducing plates must be removed. A further disadvantage is in the fans relatively large overall height, which is caused particularly by the sound reducing plates positioned on the suction side. For a sufficient operation of the sound reducing plates, same must be at least approximately 600 mm. long. A ventilating device of usual construction may then easily reach a height of 2 m. In the known roof fan according to U.S. Pat. No. 3,219,143, an impeller is used which stands vertically about its axis, however, the drive motor is above the impeller and thus enlarges the overall height. The motor must be arranged in this location to permit an easier servicing of the fan, because in this arrangement motor and blower are accessible from above by lifting off the fan enclosing cover for the fan.

U.S. Pat. No. 3,219,143 discloses a fan having an impeller with backwardly curved vanes. These impellers have in particular the disadvantage of a high noise development, which is contrary to the desired goal of sound abatement pursued by the use of a sound absorber. Therefore, fans are already known, the blowers of which have forwardly curved vanes. However, these blowers are always used as double-sized sucking blowers with a horizontal shaft. Therefore, these known constructions have the disadvantage of a very large overall height. In order to reduce the overall height of such a roof fan, it is known to construct the fan angularly. The thus achieved reduced overall height is, however, achieved through a much longer apparatus, particularly if also sound absorbers are used on the outlet side.

It is already known from German Gebrauchsmuster No. 1,901,791 to swingably secure a hood of a roof fan by means of a hinge, said hood being made of sheet metal. In this manner it is possible to easily provide access to the motor and blower during servicing. The access to the suction channels and the sound absorber is, however, not made easier in this manner because a removal of the entire blower is required.

The basic purpose of the present invention is to develop a roof fan of the above-mentioned type, in which suction tubes and sound reducing plates are easily accessible for the purpose of servicing and which is constructed in a compact and low design. Furthermore, the noise development of the fan is less than in known fans with forwardly curved vanes.

To attain this purpose, a roof fan of the above-mentioned type is utilized, which has the characteristics mentioned in the characterizing part of the main claim and additionally the characteristics mentioned in the subclaims.

The tilting mechanism of the housing surrounding the blower can be mounted on the casing of the air-quieting casing or the sound reducing device. The air-quieting casing forms a quieting zone for the conveyed air and increases the efficiency of the blower. The invention permits a lifting of the entire blower including the surrounding housing in a simple manner through a swivel movement off from the air-quieting casing or sound reducing device positioned thereunder. Same is then freely accessible from above and the sound reducing plates can be lifted out upwardly individually or together, which causes the suction channel to lie open for the servicing operation. Due to the inventive tiltable arrangement of the entire blower structure, it is possible, when a motor which does not lie within the impeller is used, to arrange said motor on the bottom side of the impeller without making the accessibility of the motor more difficult. By operating the inventively provided tilting mechanism, the motor, which from above is covered by the impeller, is easily accessible. Since this motor can project into the air-quieting casing or the upper free space of the sound reducing mechanism without effecting the air circulation, a reduction of the type of construction is achieved through the inventively arranged tilting mechanism also with respect to such known fans, in which the shaft of the impeller is arranged vertically.

The housing which surrounds the blower had regularly a greater diameter than the surface of the air-quieting casing or of the sound reducing device. Through the inventive arrangement of sound reducing devices (sound absorbers) on the pressure side of the blower in such a roof fan, neither the overall height nor the dimensions in the vertical projection of the roof fan are enlarged. Due to the fact that these sound absorbers on the pressure side are arranged removably or swingably at least on the tilting axis side, they do not make more difficult the hinging down of the blower from the casing or sound reducer positioned therebelow.

By using a blower which sucks air in on only one side and having an impeller with a large diameter and forwardly curved vanes and a spiral housing surrounding the impeller, the overall height is at the same time kept low and the same small sound development is achieved as in the known roof fans with forwardly curved vanes in which the fan is sucking on both sides and the impeller shaft extends horizontally.

For servicing the fan itself, it is advantageous to construct the lid of the housing surrounding the blower also in a conventional tiltable manner. This permits an easy access to the electric connecting means, for example, the controller, main switch and time switch, arranged in the fan housing. According to the invention, said lid of the blower housing is arranged tiltably about the same axis as the support plate itself, which carries the entire blower. In this construction, the lid is constructed preferably as a hood which overlaps the blower.

The lid, the sidewalls of the fan housing, and the surface of the sound absorbing hood are advantageously lined in a conventional manner with a not burnable, heat-insulating and sound-absorbing material. This achieves a reduction in the amount of condensed water accumulated to a minimum. Furthermore, it is advisable to provide a throttle valve for adjusting the size of the suction opening in the suction line either before or after the sound absorber on the suction side. If, in certain cases of use, the mounting of filters into the air path is necessary, then it is advisable to provide these in the air-quieting space before or behind the sound absorber, where they are easily accessible for cleaning due to the tiltable securement of the blower.

The blow-out openings can be covered on one or several sides by flaps to exclude undesired flow directions of the exiting air stream, for example, to avoid odors.

BRIEF DESCRIPTION OF THE DRAWINGS

The invention will be discussed more in detail in connection with the exemplary embodiments illustrated in the drawings, in which.

DETAILED DESCRIPTION

Figure 1:
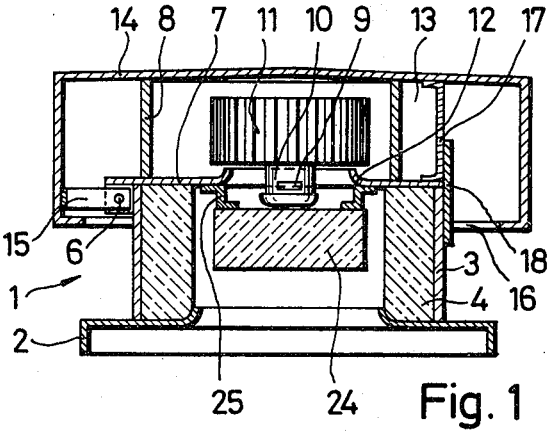
FIG. 1 is a cross-sectional view of one exemplary embodiment of a roof fan according to the invention.
Figure 2:
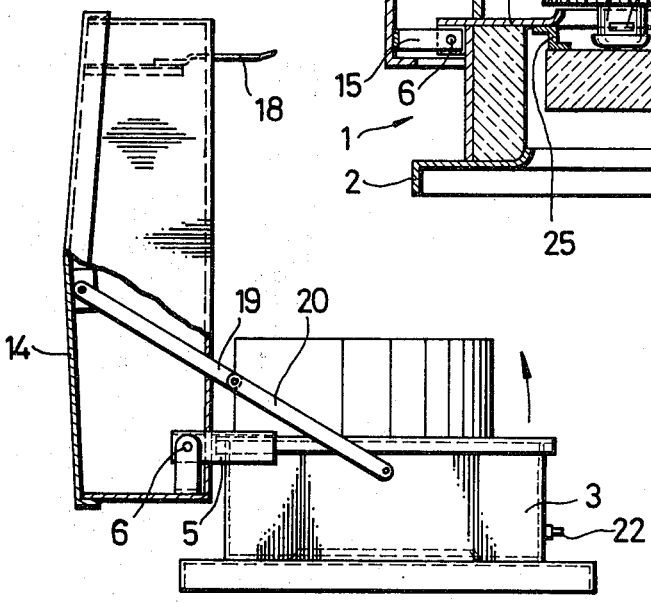
FIG. 2 is a side view of the roof fan of FIG. 1 in opened condition.
Figure 3:
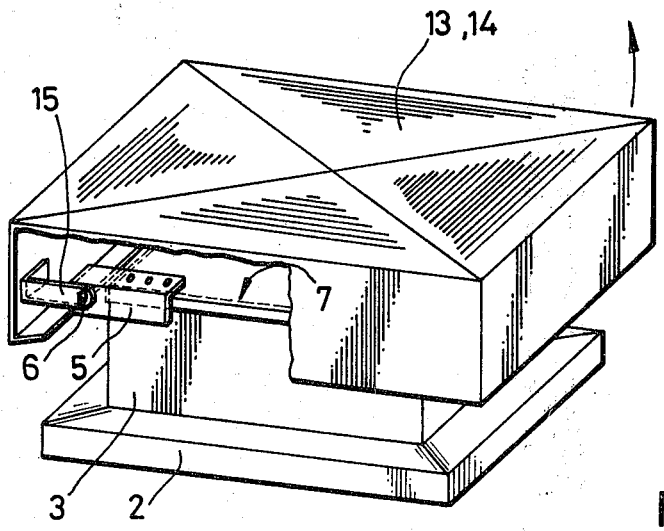
FIG. 3 is a perspective illustration of the roof fan according to FIGS. 1 and 2, and FIGS. 4, 5A and 5B illustrate a different embodiment of the invention with a sound absorber on the suction side and on the pressure side.

The inventive roof fan which is illustrated in FIGS. 1 to 3 is identified by reference numeral 1. It has a base 2, with which it can be secured on the roof. A casing 3 is mounted on the base 2, which casing is used either as a pure air-quieting casing, wherein an insulating annular lining 4 is possibly provided, or which is used to receive the sound reducing plates 24 of a sound absorber. Two angle irons 5 which together carry a shaft 6 are secured on the casing 3 which, in this particular embodiment, is square in cross section, namely on two oppositely positioned sidewalls. A support plate 7 is mounted on the air-quieting casing, which support plate can be pivoted about the axis of the shaft 6. The plate 7 supports on its upper side the spiral-shaped blower housing 8 and, through arm 9, a motor 10 and an impeller 11. The parts 8, 10 and 11 constitute the actual blower. The support plate 7 has an upwardly bent portion 12, which defines the suction opening of the blower.

A hoodlike lid 13 has arms 15 secured thereto, which arms are pivotal about the axis of the shaft 6. The lid 13 covers with its actual lid part 14 the upper side of the spiral-shaped housing 8. The lid 13, which is also square in cross section, projects with its dimensions over the housing 3 and forms an annular outlet opening 16 along its bottom side in a downwardly opening direction. The not visible outlet opening of the housing 8 ends in the lid 13. A locking device 18 is used to secure the lid in the closed position. It is secured on a U-shaped channel iron 17, which in turn is connected to the underside of the lid 13.

In the exemplary embodiment illustrated in FIGS. 1 to 3, the housing which surrounds the blower and can be tilted with same consists substantially of the support plate 7 and the far overlapping, hoodlike lid 13.

A sound reducing mechanism is identified generally by reference numeral 24, which sound reducing mechanism is mounted to the bottom side of the support plate 7 by Z-shaped angle pieces 25. Thus in this construction the sound reducer is also movable out of the way in this construction, so that the intake channel is immediately accessible. As can be seen from FIG. 2, the swivel movement of the lid 13 is limited by guide rods 19,20, one of which is hinged to the lid and the other one to the casing 3. A screw, identified by reference numeral 22, is used in connection with the locking device 18 to secure the hood.

The roof fan of the invention which is illustrated in FIGS. 4 and 5 is provided with a sound reducing mechanism on both the inlet and outlet sides of the blower. The parts in FIGS. 4 and 5 which correspond to the same parts in FIGS. 1 to 3 are provided with the same reference numerals. The roof fan 1 rests with its base plate **2*a* on a base 2. A sound reducing casing 3 on the suction side of the blower is secured to the base plate 2*a*, an air-quieting base 50 being secured to the sound reducing casing 3. The air-quieting base 50 supports the housing 56, which surrounds the blower. The impeller 11 is mounted in the housing 56, the shaft 11*a* of which extends parallel to the axis of the sound reducing casing 3 on the suction side of the blower. The shaft 11*a* of the impeller is coupled to a drive motor 10, which is located in the air-quieting space of the base 50. The impeller 11 which is constructed with forwardly curved vanes is surrounded by a spiral-shaped housing 8. The support plate 7 on which the blower parts 8, 10 and 11 are secured forms the bottom of the housing 56. The connecting means 31, for example, the controller, main switch and time switch are also arranged in the housing 56.**

The housing 56 is secured tiltably through the axis of a shaft 6 on the air-quieting base 50. When the housing 56 is tilted up, an easy access exists to the sound reducing plates 34 arranged in the sound reducing mechanism 3 and the suction channel lying therebelow. To clean the suction channel and the sound reducing mechanism, the sound reducing plates can easily be pulled out upwardly. The lid 14 of the housing 56 is pivotally supported by means of a hinge 36.

The air flow which is moved by the impeller 11 through the sound reducing casing 3 exits from the opening 37 of the spiral-shaped housing 8 into the housing 56 and leaves same through outlet openings 38 which are arranged in the bottom of the housing 56, namely the plate 7. FIG. 5A shows oval outlet openings 38, while FIG. 5B shows rectangular outlet openings. The choice of form and position of the outlet openings depends on the type of the sound reducing device 39 on the pressure side of the blower. The sound reducing device 39 is arranged as an extension of the outlet openings 38 and extends parallel to the sound reducing casing 3 on the suction side. The left half of FIG. 4 and FIG. 5A shows a sound reducing structure in a monocoque construction, its plates, which are mounted on the walls of the casing 3 and shell 39, are identified by reference numerals 40,41. The right half of FIG. 4 and FIG. 5B shows a sound reducing structure in a honeycomb construction, here outlet openings 38 alternate with plates 42.

The sound reducing device 39 on the pressure side of the blower is pivotally secured at least on one side through a hinge 43 to the housing 56 of the venting device 1. Through this pivotal mounting of the sound reducing device 39, the housing of the venting device can be pivoted away from the sound reducing casing 3 without requiring a removal of the sound reducing devices on the pressure side of the blower. This permits a simple and quick servicing of the entire venting device and the suction channels.

The embodiments of the invention in which an exclusive property or privilege claimed are defined as follows:

1. A roof mounted fan, comprising:

a base having a first opening therein;

an upstanding casing mounted on said base and having a second opening therein communicating with said first opening;

a support plate having a third opening therein pivotally secured to said upstanding casing adjacent the upper end thereof for movement between a position across said open upper end of said casing perpendicular to an axis of said casing so that said third opening is aligned with said second opening and a position out of perpendicular alignment with said axis of said casing;

blower means and drive motor means therefor mounted on said support plate, said blower means having an axis of rotation coaxial with the axis of said third opening;

sound reducing means removably mounted in said upstanding casing between said base and said support plate for reducing the sound generated by said blower means and said drive motor means; and hood means pivotally secured to at least one of said support plate and said casing and pivotal independently of said support plate for overlying said blower means and defining a chamber having an outlet therefrom;

whereby a pivoting of said hood means exposes said support plate and at least said blower means mounted thereon and a pivoting of said support plate exposes said sound reducing means, said sound reducing means being accessible from above.

2. The roof fan according to claim 1, including a drive motor for said blower means mounted on said supporting plate, said drive motor lying below said support plate and extending into said casing.

3. A roof mounted fan according to claim 1, wherein said sound reducing means is secured to said support plate and pivotal therewith.

4. A roof mounted fan according to claim 1, wherein said hood means is pivotally secured to said casing.

5. A roof mounted fan according to claim 4, wherein the pivot axis for said pivotal connection between said support plate and said casing and the pivot axis for said pivotal connection between said hood means and said casing are coaxial.

6. A roof mounted fan according to claim 1, wherein said sound reducing means are composed of a plurality of spaced and parallel plates, the planes of which are parallel to the longitudinal axis of said casing.

7. A roof mounted fan according to claim 6, including additional means encircling said casing and communicating with said outlet from said chamber, said additional means having additional sound reducing means mounted thereon to additionally reduce the sound of said blower means.

* * * * *

UNITED STATES PATENT AND TRADEMARK OFFICE

CERTIFICATE OF CORRECTION

PATENT NO. : 3 960 063

DATED : June 1, 1976

INVENTOR(S) : Franz Siemes et al

It is certified that error appears in the above-identified patent and that said Letters Patent are hereby corrected as shown below:

Please correct Applicant Kraus' name to --Andreas Kraus--.

Please insert the following priority information --Germany, 7 326 516.4, filed July 19, 1973--.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*